United States Patent [19]

Morell

[11] Patent Number: 4,974,854

[45] Date of Patent: Dec. 4, 1990

[54] GOLF BALL

[75] Inventor: Joseph Morell, Annecy, France

[73] Assignee: Salomon S.A., Annecy, France

[21] Appl. No.: 441,875

[22] Filed: Nov. 27, 1989

[30] Foreign Application Priority Data

Nov. 29, 1988 [FR] France ..... 88 15573

[51] Int. Cl.[5] ..... A63B 37/14; A63B 37/12

[52] U.S. Cl. ..... 273/232; 40/327

[58] Field of Search ..... 273/232; 40/327

[56] References Cited

U.S. PATENT DOCUMENTS 4,762,326 8/1988 Gobush ..... 273/232

4,844,472 7/1989 Ihara ..... 273/232

FOREIGN PATENT DOCUMENTS 2322624 4/1977 France ..... 273/232

*Primary Examiner*—George J. Marlo

[57] ABSTRACT

The present invention relates to a golf ball.

In order to improve the indifferent character of the orientation of the ball with respect to the strike, the peripheral surface (2) of it has dimples (123,124,125,126) essentially distributed inside 126 elemental surfaces (104,105,106,115), delimited by 12 equatorial circles (92 to 103) of the sphere defining the general shape of the peripheral surface (2) of the ball (3), on the basis of:

- 6 identical elemental surfaces (104) of spherical, regular octagonal form,
- 48 identical elemental surfaces (105) of spherical triangular form,
- 3 groups of 24 identical elemental surfaces (106,231,115) of spherical quadrilateral form having two equal opposite angles (107,108,131,116,117) and two different opposite angles (109,110,133,134,118,119) defined by two respective equal length sides (111,112,113,114,135, 136,137,138,120,121,122,123).

16 Claims, 2 Drawing Sheets

GOLF BALL

The present invention relates to a golf ball of the type having a peripheral surface having the general shape of a sphere and a plurality of dimples arranged in the said peripheral surface and distributed on the latter in accordance with at least one repetitive motif, at least essentially insde elemental spherical surfaces defined by subdivision of the said peripheral surface along arcs of circles centered on the centre of the sphere and mutually connecting points of the peripheral surface corresponding to points determined by a polyhedron inscribed in the sphere.

A golf ball of this type is described in French patent No. 735,555, which, more precisely, describes a subdivision into 20 spherical triangles based on inscription of an icosahedron, a sub-division into 12 spherical pentangles based on inscription of a dodecahedron, a subdivision into 8 spherical triangles based on inscription of octahedron, a sub-division into 24 spherical triangles based on inscription of a hexadron or cube of which each face is itself sub-divided into 4 triangles by the diagonals, and a sub-division into 6 spherical triangles based on inscription of a tetrahedron; each of the elemental spherical surfaces thus defined is then subdivided in accordance with a motif which determines the position of the dimples.

This known mode of sub-division of the peripheral surface of a golf ball has an inconvenience in that the behaviour of the latter in its trajectory is narrowly tied to the orientation of the ball with respect to the strike; in effect, even if the dimples are arranged with the same motif in the 6,8,12,20 or 24 elemental surfaces, in spherical triangular or pentagonal form, resulting from this mode of sub-division, the probability of successive strikes hitting the peripheral surface of the ball in its zones having different geometries is significant; in other words, unless great care is taken in the positioning of the ball before the strike, in a manner difficult to practically envisage, a ball having the distribution of dimples recommended in French patent No. 735,555 will not lend itself to suitable reproduceability of strikes, and consequently of trajectories.

The object of the present invention is to remedy this inconvenience by proposing, also from a polyhedron inscribed inside the sphere, a finer sub-division of the surface of this, in order to increase the homogeneity of distribution of the dimples and consequently to obtain a characteristic as indifferent as possible to the orientation of the ball with respect to the strike.

To this end, the ball of the invention, of the type indicated in the preamble, is characterised in that the said polyhedron is a hexa-octahedron and in that the said sub-division is carried out along 12 equatorial circles of which each is centred on an axis passing through the respective mid-points of the diametrically opposed edges of the hexa-octahedron, and passes through 2 diametrically opposed apices of this in a manner to define:

- 6 identical elemental surfaces of spherical, regular octagonal form,
- 48 identical elemental surfaces in the form of spherical triangles having an obtuse angle,
- 24 first identical elemental surfaces in the form of spherical quadrilaterals having 2 opposite angles equal to the said obtuse angle and 2 different opposite angles, defined by 2 respective edges of equal length,
- 24 second identical elemental surfaces in the form of spherical quadrilaterals different from the said spherical quadrilateral and having 2 opposite angles equal to the said difference between 180° and the said obtuse angle and 2 different opposite angles, defined by 2 respective sides of equal length,
- 24 identical elemental surfaces in the form of spherical quadrilaterals different from the said spherical quadrilaterals and having 2 opposite angles equal to the said difference and 2 different opposite angles defined by 2 respective sides of equal length.

With respect to the disposition described in the mentioned French patent, the number of elemental surfaces is substantially multiplied, which considerably increases the homogeneity of distribution of the dimples and consequently the probability of an identical relative orientation of a dimple and of the strike for successive strikes; preferably, the dimples are distributed according to an identical motif in each of the elemental surfaces, which again increases this probability, but the scope of the present invention will not be departed from by providing other arrangements in this regard, and particularly in providing more disposition motifs for the dimples in the identical elemental surfaces, each motif being attributed to some of the identical elemental surfaces regularly distributed on the sphere.

Particularly for reasons of ease of manufacture, it is preferred that at least one determined equatorial circle, amongst the said equatorial circles, cuts none of the dimples; this determined circle can correspond to a joint plane when the ball is manufactured by assembly of two identical halves or when at least one surface layer of it, including the dimples, is made by moulding in a single piece in a mould itself formed of two assembled identical halves; taking account of the fine sub-division of the peripheral surface of the ball and of the homogeneity of distribution of the dimples which results, one can then allow one of the halves of the ball or of the mould, respectively, possibly to be angularly displaced with respect to the other half about the axis of the said determined equatorial circle; in this case, the said determined equatorial circle sub-divides each of the other said equatorial circles into two circular arcs, of which each corresponds to one of two hemispheres defined by the said determined equatorial circle, and the circular arcs of one of the hemispheres are angularly displaced, with respect to the respectively corresponding circular arcs of the other of the hemispheres, by the same amount about the axis of the said determined equatorial circle; the fact of allowing such a disposition considerably eases the manufacture of the ball by assembly of two halves or by moulding in a mould formed of two assembled halves, because it is not necessary to perform a precise adjustment of the relative angular position of the two halves of the ball or of the mould, respectively, in manufacture of the ball.

Other characteristics and advantages of a ball according to the present invention will appear from the description below, relating to a non-limitative embodiment, as well as from the accompanying drawings which form an integral part of this description.

Figure 1:
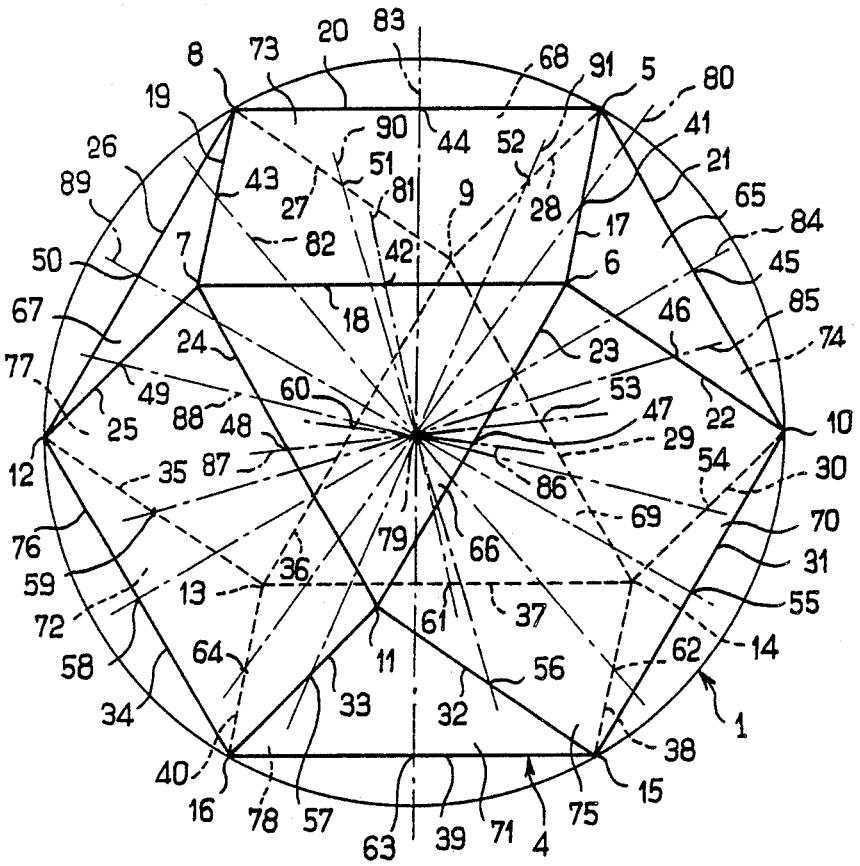
FIG. 1 illustrates the construction, in accordance with the present invention, of 12 equatorial circles on a sphere from a hexa-octahedron inscribed in this latter.
Figure 2:
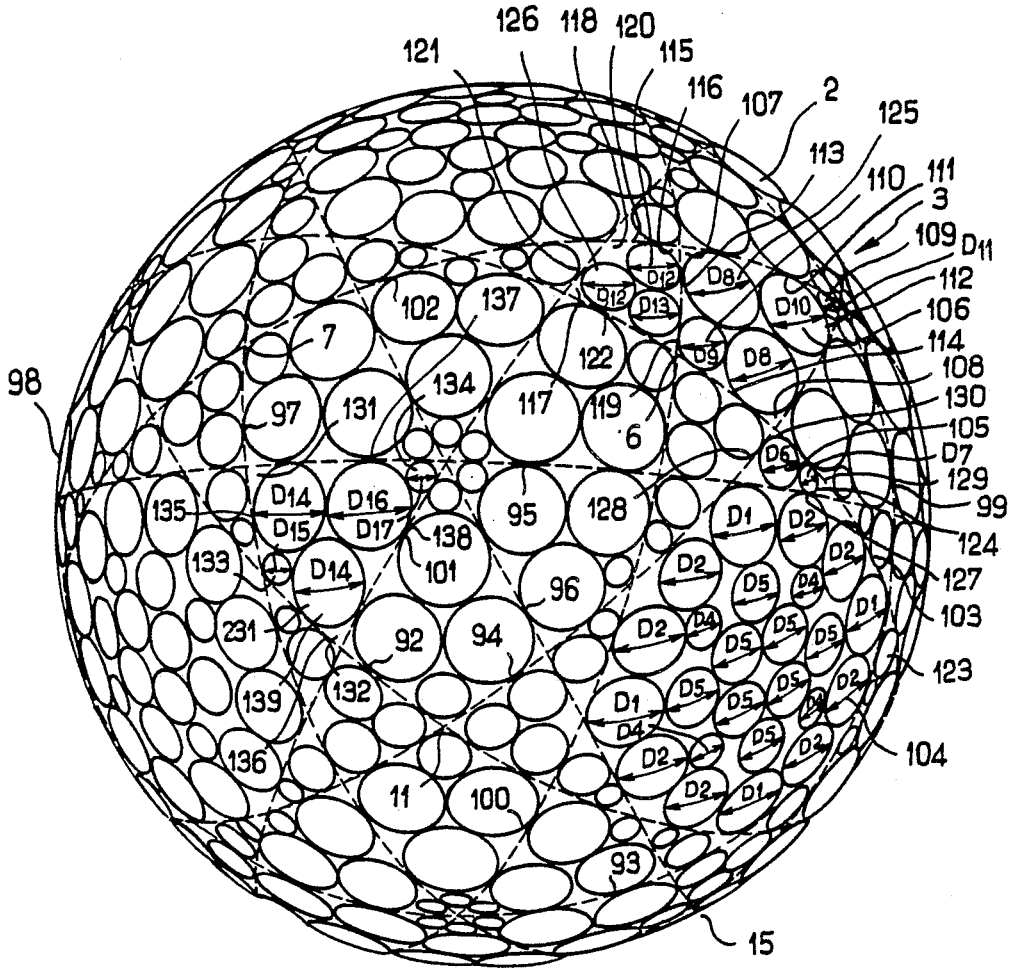
FIG. 2 shows a golf ball of which the dimples are distributed in the 126 elemental surfaces obtained by this sub-division by means of 12 equatorial circles.

Referring in the first place to FIG. 1 where there is designated by 1 a sphere producing the general shape of the peripheral surface 2 of a golf ball 3 illustrated in FIG. 2, and by 4 a hexa-octahedron inscribed in this sphere 1 on which there are 12 apices 5 to 16 connected in pairs by 24 edges 17 to 40 of which each has a mid-point 41 to 64 and which, respectively in threes and fours, define 8 triangular faces 65 to 72 and 6 square faces 73 to 78; the hexa-octahedron 4 and the sphere 1 have a common centre 79 which will serve as a reference when reference is made below to the concept of diametrically opposed positions or of radial projection.

For geometrical reasons, the edges 17 to 40 of the hexa-octahedron 4 are distributed in 12 groups of two mutually parallel, diametrically opposed edges, that is to say edges 17 and 40, 18 and 37, 15 and 38, 20 and 39, 21 and 34, 22 and 35, 23 and 36, 24 and 29, 25 and 30, 26 and 31, 27 and 32, 28 and 33, of which the respective mid-points also occupy diametrically opposed positions; in accordance with the present invention, by means of the respective mid-points of two edges also diametrically opposed, axes are determined, that is to say the axis 80 passing through the mid-points 41 and 64, the axis 81 passing through the mid-points 42 and 61, the axis 82 passing through the mid-points 43 and 62, the axis 83 passing through the mid-points 44 and 63, the axis 84 passing through the mid-points 45 and 58, the axis 85 passing through the mid-points 46 and 59, the axis 86 passing through the mid-points 47 and 60, the axis 87 passing through the mid-points 48 and 53, the axis 88 passing through the mid-points 49 and 54, the axis 89 passing through the mid-points 50 and 55, the axis 90 passing through the mid-points 51 and 56, and the axis 91 passing through the mid-points 52 and 57 around each of the 12 axes thus determined, in a plane (not referenced) perpendicularly cutting this axis at the centre 49 of the hexa-octahedron 4 and of the sphere 1, is traced on this sphere 1 an equatorial circle passing through 2 diametrically opposed apices of the hexa-octahedron, that is to say the circle 92 having the axis 80, passing through the apices 9 and 11, the circle 93 having the axis 81, passing through the apices 10 and 12, the circle 94 having the axis 82, passing through the apices 9 and 11, the circle 95 having the axis 83, passing through the apices 10 and 12, the circle 96 having the axis 84, passing through the apices 8 and 15, the circle 97 having the axis 85, passing through the apices 7 and 14, the circle 98 having the axis 86, passing through the apices 5 and 16, the circle 99 having the axis 87, passing through the apices 8 and 15, the circle 100 having the axis 88, passing through the apices 6 and 13, the circle 101 having the axis 89, passing through the apices 5 and 16, the circle 102 having the axis 90, passing through the apices 7 and 14, the circle 103 having the axis 91, passing through the apices 6 and 13; for reasons of clarity, these 12 circles 92 to 103 are represented on the peripheral surface 2 of the ball 3 in FIG. 2, and not on the sphere 1 in FIG. 1, but it will be noted that it is not necessary for these circles to be materially reproduced on this surface 2.

As appears more particularly in FIG. 2, the equatorial circles thus defined delimit between themselves, in threes, or in fours, or in eights, elemental surfaces distributed into 4 groups of mutually identical elemental surfaces, that is to say:.

1 group of 6 identical elemental surfaces 104 in the form of regular spherical octagons with sides 127 and apex angles 131, regularly distributed on the sphere 1, 1 group of 48 identical elemental surfaces 105, in circle triangular form, regularly distributed in sub-groups of 8 around different elemental surfaces 104 of which each side 127 defines a side of this spherical triangle; opposite from this side 127, each spherical triangle has an obtuse angle 130 between 2 sides 128,129 having different lengths, the side 128 being shorter than the side 129 itself shorter than the side 127;

1 group of 24 identical elemental surfaces 106, in the form of spherical quadrilaterals having 2 opposite angles such as 107,109 equal to the angle 130 and 2 different opposite angles such as 109,110, defined by 2 respective sides of equal length such as, respectively, on the one hand comparatively long sides 111,112, and on the other hand comparatively short sides 113,114; these elemental surfaces 106 are distributed in sub-groups of 3 regularly distributed on the sphere 1;

1 group of 24 identical elemental surfaces 231 in the form of spherical quadrilaterals different from the above mentioned spherical quadrilateral and having 2 opposite sides such as 131,132 equal to the difference between 180° and the obtuse angle 130 and 2 different opposite angles 133,134 defined by 2 respective sides of equal length such as, respectively, on the one hand comparatively short sides 135 and 136 and of which each coincides with a large side such as 129 of the obtuse angle 130 of a respective surface element 105, and on the other hand comparatively long sides 137 and 138 and of which each coincides with a respective one of the long sides such as 111 and 112 of a respective elemental surface 106; these 2 elemental surfaces 231 are distributed in sub-groups of 3 distributed on the sphere 1 and in which they alternate with the elemental surfaces 106;

1 group of 24 identical elemental surfaces 115 in the form of spherical quadrilaterals different from the above mentioned spherical quadrilaterals and having 2 opposite angles such as 116,117 equal to the difference between 180° and the obtuse angle 130 and 2 different opposite angles such as 118,119 defined by 2 respective sides of equal length such as, respectively, on the one hand comparatively short sides 120 and 121 and of which each coincides with a small side such as 128 of the obtuse angle 130 of a respective elemental surface 105, and on the other hand comparatively long sides 122 and 113, and of which each coincides with a respective one of the smaller sides 113,114 of a respective surface element 106; these elemental surfaces 115 are regularly distributed in sub-groups of 4 about different surface elements 104.

In each of the identical surface elements 104 or 105 or 106 or 231 or 115 are distributed, in accordance with a preferably identical motif, such as is illustrated, dimples such as 123,124,125,126,139 here 24 in number per elemental surface 104, 2per elemental surface 105, 5 per elemental surface 106 or 231 and 3 per elemental surface 115, the number of dimples thus arranged in elemental surfaces of identical shape as well as the motif in accordance with which these dimples are arranged in these elemental surfaces, and the concrete form of these dimples, here in the form of part spherical depressions, being able to be varied to a large extent without departing from the scope of the present invention.

More precisely, in the non-limitative illustrated example the dimples such as 123 defined by their intersection with the spherical peripheral surface of the ball with a diameter of the order of 42.67 mm, circles distributed in the following manner in each elemental surface such as 104:

- 4 circles of diameter $D_1$ of the order of 1.94 mm of which each is approximately tangential to 2 adjacent sides 127 of the regular spherical octagon, in an apex angle 131, on 2 of these,
- 8 circles of diameter $D_2$ of the order of 1.80 mm of which each is approximately tangential to a respective side 127 of the regular spherical octagon and, to a respective one of the said circles of diameter $D_1$ and which are distributed in 4 groups of 2 of these circles approximately mutually tangential, each of these groups being arranged between the 2 said circles of diameter $D_1$, neighbouring to which the 2 circles of this group are respectively approximately tangential,
- 4 circles of diameter $D_4$ of the order of 1.01 mm of which each is approximately tangential to 2 circles of diameter $D_2$ of one of the said groups,
- 8 circles of diameter $D_5$ of the order of 1.50 mm, distributed in a first group of 4 circles of which each is approximately tangential to a respective one of the said circles of diameter $D_1$ and in a second group of 4 circles approximately tangential in pairs and of which each is approximately tangential on the one hand to 2 of the circles of the said first group and on the other hand to a respective one of the said circles of diameter $D_4$.

Further, in this non-limitative example, the dimples such as 124 define, by their intersection with the peripheral surface 2 of the ball, circles distributed in the following manner in each elemental surface such as 105:

- 1 circle of diameter D6 of the order of 1.28 mm, approximately tangential to the side 127 opposite the obtuse angle 130 of the spherical triangle and 2 sides 128,129 of the obtuse angle 130 of the spherical triangle,
- 1 circle of diameter $D_7$ of the order of 0.70 mm, approximately tangential to the circle of diameter $D_6$, to the side 127 opposite the obtuse angle 130 and to the larger side 129 of the obtuse angle 130.

Further, in this non-limitative example, the dimples such as 125 define, by their intersection with the peripheral surface 2 of the ball, circles distributed in the following manner in each elemental surface such as 106:

- 2 circles of diameter $D_8$ of the order of 2.20 mm, 20 approximately mutually tangential and approximately tangential respectively to 2 sides 111,113 and 112,114 of a respective one of the equal angles 107 and 108 of the spherical quadrilateral,
- 1 circle of diameter $D_9$ of the order of 1.30 mm, approximately tangential to 2 circles of diameter $D_8$ and to 2 comparatively short sides 113,114 of the spherical quadrilateral,
- 1 circle of diameter $D_{10}$ of the order of 2.30 mm, approximately tangential to 2 circles of diameter $D_8$ and to comparatively long sides 11,112 of the spherical quadrilateral,
- 1 circle of diameter $D_{11}$ of the order of 0.80 mm, approximately tangential to the circle of diameter $D_{10}$ and to 2 comparatively long sides 111,112 of the spherical quadrilateral.

Further in this non-limitative example the dimples such as 139 define, by their intersection with the peripheral surface 2 of the ball, circles distributed in the following manner in each elemental surface such as 231:

- 2 circles of diameter $D_{14}$ of the order of 2.07 mm, approximately mutually tangential and approximately tangential respectively to 2 sides 135,137 and 136,138 of a respective one of the equal angles 131 and 132 of the spherical quadrilateral,
- 1 circle of diameter $D_{15}$ of the order of 0.80 mm, approximately tangential to 2 circles of diameter $D_{14}$ and to 2 comparatively short sides 135,136 of the spherical quadrilateral,
- 1 circle of diameter $D_{16}$ of the order of 2.11 mm, approximately tangential to 2 circles of diameter $D_{14}$ and to 2 comparatively long sides 137,138 of the spherical quadrilateral,
- 1 circle of diameter $D_{17}$ of the order of 0.73 mm, approximately tangential to the circle of diameter $D_{16}$ and to the 2 comparatively long sides 137,138 of the spherical quadrilateral.

Finally in this non-limitative example the dimples such as 126 define, by their intersection with the peripheral surface 2 of the ball, circles distributed in the following manner in each elemental surface such as 115:

- 2 circles of diameter $D_{12}$ of the order of 1.41 mm, approximately mutually tangential and approximately tangential respectively to 2 sides 113,120 and 121,122 of a respective one of the equal angles 116,117 of the spherical quadrilateral,
- 1 circle of diameter $D_{13}$ of the order of 1.30 mm, approximately tangential to 2 circles of diameter $D_{12}$ and to the 2 comparatively long sides 113,122 of the spherical quadrilateral.

With reference to the circle peripheral surface 2 of the ball, each of the dimples such as 123,124,125,126 has in this non-limitative example a depth increasing with the diameter of its intersection with the peripheral surface 2, that is to say a depth of the order of 0.10 mm for the dimples such as 123,124,125,126 corresponding to the above mentioned circles of smallest diameter, to 0.5 mm, for the dimples such as 123,124,125,126 corresponding to the above mentioned circles of largest diameter; as with the values of the diameters $D_1$, $D_2$, $D_3$, $D_4$, $D_5$, $D_6$, $D_7$, $D_8$, $D_9$, $D_{10}$, $D_{11}$, $D_{12}$, these values of depth are indicated only by way of non-limitative example.

The dimples such as 123,124,125,126,139 cut none of the equatorial circles 92 to 103 in the illustrated example.

Possibly, in a non-shown manner, certain of the dimples such as 123,124,125,126,139 can be permitted to overlap the immediately neighbouring equatorial circles, amongst the equatorial circles 92 to 103; preferably however, at least one of the equatorial circles cuts none of the dimples such as 123,124,125,126, to correspond with a joint plane between 2 halves of the ball if it is made in 2 halves or between 2 halves of a mould intended for the production of the ball, or at least a surface layer of this having the dimples, in a single piece by moulding; in a non-illustrated manner, this determined equatorial circle can sub-divide each of the other equatorial circles into 2 circular arcs mutually angularly displaced, by the same amount, about the axis of this equatorial circle, which will certainly cause the disappearance of the mentioned symmetries but is not really harmful to the homogeneity of distribution of the dimples such as 123,124,125,126 on the peripheral surface 2 of the ball 3.

In a general manner, the present invention is susceptible of numerous variants without departing from its scope.

I claim

1. A golf ball comprising a peripheral surface having a general form of a sphere and a plurality of dimples arranged in said peripheral surface and distributed on the latter in accordance with at least one repetitive motif defined by sub-division of said peripheral surface along arcs of circles centred on a centre of said sphere and mutually connecting points of said peripheral surface corresponding to determined points of a polyhedron inscribed in said sphere, said circular arcs defining elemental spherical surfaces and said dimples being essentially inside said elemental surfaces wherein said polyhedron is a hexa-octohedron and said sub-division is carried out along 12 equatorial circles of which each is centred on an axis passing through respective mid-points of 2 diametrically opposed edges of said hexa-octahedron, and passes through 2 diametrically opposed apices of this in a manner to define:

6 identical ones of said elemental surfaces having spherical, regular octagonal form, 48 identical ones of said elemental surfaces having spherical triangle form having an obtuse angle, 24 first identical ones of said elemental surfaces in the form of spherical quadrilaterals having 2 opposite angles equal to said obtuse angle and 2 different opposite angles, defined by 2 respective equal length sides, 24 second identical ones of said elemental surfaces in the form of spherical quadrilaterals different from said spherical quadrilaterals and having 2 opposite angles equal to the difference between 180° and said obtuse angle and 2 different opposite angles defined by 2 respective sides of equal length, 24 third identical ones of said elemental surfaces in the form of spherical quadrilaterals different from said spherical quadrilaterals and having 2 opposite angles equal to said difference and 2 different opposite angles, defined by 2 respective sides of equal length.

2. A golf ball according to claim 1, wherein at least a determined one of said equatorial circles cuts none of said dimples.

3. A golf ball according to claim 2, wherein said determined equatorial circle sub-divides each of the other said equatorial circles into two circular arcs, of which each corresponds to one of two hemispheres defined by said determined equatorial circle, and said circular arcs of one of said hemispheres are angularly displaced, with respect to respectively corresponding ones of said circular arcs of the other of said hemispheres, by the same amount about an axis of said determined equatorial circle.

4. A golf ball according to claim 2, wherein none of said equatorial circles cuts one of said dimples.

5. A golf ball according to claim 1, wherein said dimples are distributed in accordance with an identical motif in identical ones of said elemental surfaces.

6. A golf ball according to claim 5, wherein said sphere has a diameter of the order of 42.67 mm, and said dimples define, by their intersection with said peripheral surface, circles distributed in the following manner in each said elemental surface in regular spherical octagonal form:

4 circles of diameter $D_1$ of the order of 1.94 mm, of which each is approximately tangential to 2 adjacent sides of said regular spherical octagon, in an angle at an apex on 2 of these, 8 circles of diameter $D_2$ of the order of 1.80 mm, of which each is approximately tangential to a respective side of said regular spherical octagon and to a respective one of said circles of diameter $D_1$ and which are distributed in 4 groups of 2 of these circles approximately mutually tangential, each of these groups being arranged between 2 of said circles of diameter $D_1$ neighbouring to which the 2 circles of this group are respectively approximately tangential, 4 circles of diameter $D_4$ of the order of 1.01 mm, of which each is approximately tangential to 2 said circles of diameter $D_2$ of one of said groups, 8 circles of diameter $D_5$ of the order of 1.50 mm, distributed in a first group of 4 circles of which each is approximately tangential to a respective one of said circles of diameter $D_1$ and in a second group of 4 circles approximately tangential in pairs and of which each is approximately tangential on the one hand to 2 circles of said first group and on the other hand to a respective one of said circles of diameter $D_4$.

7. A golf ball according to claim 6, wherein each dimple has a depth of the order of 0.1 mm to 0.5 mm increasing with correspondingly increasing diameter of said circle.

8. A golf ball according to claim 5, wherein said peripheral surface has the general shape of a sphere of diameter of the order of 42.67 mm, and said dimples define, by their intersection with said peripheral surface, circles distributed in the following manner in each said elemental surface in circular triangular form, of which said obtuse angle is situated between 2 sides of different lengths:

1 circle of diameter $D_6$ of the order of 1.28 mm, approximately tangential to a side opposite from said obtuse angle of said spherical triangle and to 2 sides of said obtuse angle of said spherical triangle, 1 circle of diameter $D_7$ of the order of 0.70 mm, approximately tangential to said circle of diameter $D_6$, to said side opposite from said obtuse angle and to a larger one of said sides of said obtuse angle.

9. A golf ball according to claim 8, wherein each dimple has a depth of the order of 0.1 mm to 0.5 mm increasing with correspondingly increasing diameter of said circle.

10. A golf ball according to claim 5, wherein said sphere has a diameter of the order of 42.67 mm, and said dimples define, by their intersection with said peripheral surface, circles distributed in the following manner in each said first elemental surface in spherical quadrilateral form:

2 circles of diameter $D_8$ of the order of 2.20 mm, approximately mutually tangential and approximately tangential respectively to 2 sides of a respective one of said equal angles of said spherical quadrilateral, 1 circle of diameter $D_9$ of the order of 1.30 mm, approximately tangential to said 2 circles of diameter $D_8$ and to 2 comparatively short sides of said spherical quadrilateral, 1 circle of diameter $D_{10}$ of the order of 2.30 mm, approximately tangential to said 2 circles of diameter $D_8$ and to 2 comparatively long sides of said spherical quadrilateral, 1 circle of diameter $D_{11}$ of the order of 0.80 mm, approximately tangential to said circle diameter $D_{10}$ and to said 2 comparatively long sides of said spherical quadrilateral.

11. A golf ball according to claim 10, wherein each dimple has a depth of the order of 0.1 mm to 0.5 mm increasing with correspondingly increasing diameter of said circle.

12. A golf ball according to claim 5, wherein said sphere has a diameter of the order of 42.67 mm, and said dimples define, by their intersection with said peripheral surface, circles distributed in the following manner in each said second elemental surface of spherical quadrilateral form:

2 circles of diameter $D_{14}$ of the order of 2.07 mm, approximately mutually tangential and approximately tangential respectively to 2 sides of a respective one of said equal angles of said spherical quadrilateral, 1 circle of diameter $D_{15}$ of the order of 0.80 mm, approximately tangential to said 2 circles of diameter $D_{14}$ and to 2 comparatively short sides of said spherical quadrilateral, 1 circle of diameter $D_{16}$ of the order of 2.11 mm, approximately tangential to said 2 circles of diameter $D_{14}$ and to 2 comparatively long sides of said spherical quadrilateral, 1 circle of diameter $D_{17}$ of the order of 0.73 mm, approximately tangential to said circle of diameter $D_{16}$ and to said 2 comparatively long sides of said spherical quadrilateral.

13. A golf ball according to claim wherein each dimple has a depth of the order of 0.1 mm to 0.5 mm increasing with correspondingly increasing diameter of said circle.

14. A golf ball according to claim 5, wherein said sphere has a diameter of the order of 42.67 mm, and said dimples define, by their intersection with said peripheral surface, circles distributed in the following manner In each said third elemental surface of spherical quadrilateral form, 2 circles of diameter $D_{12}$ of the order of 4.41 mm, approximately mutually tangential and approximately tangential respectively to 2 sides of a respective one of said equal angles of said spherical quadrilateral, 1 circle of diameter $D_{13}$ of the order of 1.30 mm, approximately tangential to said 2 circles of diameter $D_{12}$ and to 2 comparatively long sides of said spherical quadrilateral.

15. A golf ball according to claim 14 wherein each dimple has a depth of the order of 0.1 mm to 0.5 mm increasing with correspondingly increasing diameter of said circle.

16. A golf ball according to claim 1, wherein each dimple has a shape of a spherical depression.

* * * * *